US010793324B2

(12) United States Patent
Oliveira et al.

(10) Patent No.: US 10,793,324 B2
(45) Date of Patent: Oct. 6, 2020

(54) CONTAINER SYSTEMS

(71) Applicant: The Procter & Gamble Company, Cincinnati, OH (US)

(72) Inventors: Nicolas Robert Nuno Cromarty Oliveira, Ferrieres (BE); Thierry Christian Francis Dagnelie, Waterloo (BE); Vincent Hubert M. De Wilde, Kessel-Lo (BE); Clara Sophie Lea Ng Pak Leung, Ixelles (BE); Raf Gustaaf Alfons Degeyter, Herk-de-Stad (BE); Katrien De Malsche, Hamme (BE); Annalise Charlotte Richmond, Nijlen (BE); David Brian Dawson, Greensboro, NC (US)

(73) Assignee: The Procter & Gamble Company, Cincinnati, OH (US)

( * ) Notice: Subject to any disclaimer, the term of this patent is extended or adjusted under 35 U.S.C. 154(b) by 362 days.

(21) Appl. No.: 15/807,608

(22) Filed: Nov. 9, 2017

(65) Prior Publication Data

US 2018/0134466 A1 May 17, 2018

Related U.S. Application Data

(60) Provisional application No. 62/420,609, filed on Nov. 11, 2016.

(51) Int. Cl.
*B65D 43/22* (2006.01)
*B65D 43/16* (2006.01)

(52) U.S. Cl.
CPC ..... *B65D 43/22* (2013.01); *B65D 43/163* (2013.01); *B65D 43/166* (2013.01); *B65D 2251/1008* (2013.01)

(58) Field of Classification Search
CPC ..... B65D 43/22; B65D 2251/1058
See application file for complete search history.

(56) References Cited

U.S. PATENT DOCUMENTS

| | | | | |
|---|---|---|---|---|
| 5,671,853 | A | 9/1997 | Herr | |
| 5,836,465 | A | 11/1998 | King | |
| 6,092,690 | A | 7/2000 | Bitowft | |
| 6,371,316 | B1 * | 4/2002 | Herr | B65D 50/045 215/204 |
| 6,499,626 | B1 | 12/2002 | Julius | |
| 6,655,544 | B1 | 12/2003 | Tanaka et al. | |

(Continued)

FOREIGN PATENT DOCUMENTS

| | | |
|---|---|---|
| CN | 202358450U U | 8/2012 |
| CN | 303188596 | 4/2015 |

(Continued)

OTHER PUBLICATIONS

U.S. Appl. No. 15/807,607, filed Nov. 9, 2017, Thierry Christian Francis Dagnelie.

(Continued)

*Primary Examiner* — Shawn M Braden
(74) *Attorney, Agent, or Firm* — Gregory S. Darley-Emerson

(57) ABSTRACT

Container systems and closure systems having lids with a closed position, an intermediate open position, and a fully open position. Processes related thereto.

7 Claims, 10 Drawing Sheets

(56) References Cited

U.S. PATENT DOCUMENTS

| | | | | |
|---|---|---|---|---|
| 6,951,292 | B2 * | 10/2005 | Bando | B65D 83/0805 220/254.5 |
| 6,986,434 | B1 * | 1/2006 | Getsy | B65D 47/0828 220/254.3 |
| 7,073,679 | B1 | 7/2006 | Lagler et al. | |
| 7,290,673 | B2 | 11/2007 | Hagano | |
| 7,753,228 | B2 | 7/2010 | Yuhara | |
| 7,988,014 | B2 | 8/2011 | Jan et al. | |
| D653,105 | S | 1/2012 | Degeyter et al. | |
| 8,360,257 | B2 | 1/2013 | Sebille et al. | |
| 8,371,463 | B2 | 2/2013 | Beecroft | |
| 8,540,116 | B2 | 9/2013 | Giraud et al. | |
| 8,720,740 | B2 | 5/2014 | Bratsch | |
| 8,973,242 | B2 | 3/2015 | Damaghi et al. | |
| 9,150,340 | B2 | 10/2015 | Pawlik | |
| 9,718,589 | B2 | 8/2017 | Kopulos et al. | |
| 2009/0020493 | A1 | 1/2009 | Yeager | |
| 2011/0309098 | A1 | 12/2011 | Hayashi et al. | |
| 2012/0325691 | A1 | 12/2012 | Wang | |
| 2014/0151388 | A1 | 6/2014 | Culeron et al. | |
| 2014/0305819 | A1 | 10/2014 | Hill et al. | |
| 2016/0000245 | A1 * | 1/2016 | Sims | A47G 19/2272 220/253 |
| 2017/0349341 | A1 | 12/2017 | Girardot et al. | |

FOREIGN PATENT DOCUMENTS

| | | | |
|---|---|---|---|
| DE | 202014010527 | U1 | 12/2015 |
| EA | 2628688 | A1 | 8/2013 |
| EP | 000091103-0001 | | 2/2004 |
| EP | 000091103-0002 | | 2/2004 |
| EP | 000101829-0002 | | 2/2004 |
| EP | 000101829-0005 | | 2/2004 |
| EP | 000810841-0001 | U | 11/2007 |
| EP | 000799788-0002 | | 6/2009 |
| EP | 002693002-0001 | | 5/2015 |
| EP | 002693002-0002 | | 5/2015 |
| EP | 002693002-0003 | | 5/2015 |
| EP | 002693002-0004 | | 5/2015 |
| EP | 002289256-0001 | | 8/2015 |
| JP | H09315453 | A | 12/1997 |
| JP | 2001048210 | A | 2/2001 |
| JP | 2003170950 | A | 6/2003 |
| JP | D1409814 | | 3/2011 |
| WO | WO2007110106 | A1 | 10/2007 |

OTHER PUBLICATIONS

U.S. Appl. No. 15/807,609, filed Nov. 9, 2017, Thierry Christian Francis Dagnelie.

U.S. Appl. No. 15/807,610, filed Nov. 9, 2017, Vincent Hubert M. De Wilde.

* cited by examiner

CONTAINER SYSTEMS

FIELD OF THE INVENTION

The present disclosure relates to container systems and closure systems having lids with a closed position, an intermediate open position, and a fully open position. The present disclosure further relates to related processes.

BACKGROUND OF THE INVENTION

Containers having hinged lids that automatically pop fully open when unlocked are known. Such containers are convenient and enjoyable to use. However, such containers may accidentally open fully during storage or transport when jostled or dropped, resulting in undesirable spillage of the contents contained therein. There is a need for improved containers that include "pop-up" hinged lids.

Certain containers may also contain water-sensitive material. When such containers are not closed completely, water in liquid or vapor form may enter and adversely affect the water-sensitive material contained therein. There is a need for improved containers that include water-sensitive material.

SUMMARY OF THE INVENTION

The present disclosure relates to container systems, closure systems, and processes related thereto.

The present disclosure relates to a process of accessing a container system that contains a material, where the container system includes a container having an opening that provides access to a storage volume and a hinged lid having a closed position that covers the opening, the lid further having a predetermined intermediate open position that forms a first angle to the closed position and a predetermined fully open position that forms a second angle relative to the closed position, where the second angle is greater than the first angle, the container system further including a biasing means that urges the lid to the intermediate open position and/or the fully open position. The process may include the steps of: a first accessing step where a locking means is disengaged to allow the biasing means to move the lid from the closed position to the intermediate open position, the lid is then manually urged by a user from the intermediate open position to the fully open position, material is removed from the storage volume, and the container system is closed by moving the lid from the fully open position to the closed position; and a second accessing step where the locking means is disengaged and the biasing means urges the lid from the closed position to the fully open position, bypassing the intermediate open position without additional intervention.

The present disclosure also relates to a container system that includes: a container having an opening that provides access to a storage volume; a hinged lid having a closed position that covers the opening, the lid further having a predetermined intermediate open position that forms a first angle to the closed position and a predetermined fully open position that forms a second angle relative to the closed position, where the second angle is greater than the first angle; a locking means that secures the lid in the closed position; and a biasing means that urges the lid to the intermediate open position and/or the fully open position, where upon a first accessing step, a locking means is disengaged to allow the lid to be moved from the closed position to the intermediate open position, where a user must activate the biasing means by urging the lid from the intermediate open position to the fully open position, and where upon a second accessing step, the activated biasing means urges the lid from the closed position to the fully open position when the locking means is disengaged.

The present disclosure also relates to a container system that includes: a container body having an opening that provides access to a storage volume; a hinged lid having a closed position that covers the opening and an open position that allows access to the storage volume; a locking means that secures the lid in the closed position; a biasing means that urges the lid to the open position when the locking means are not engaged when the lid is moved from the open position in the direction of the closed position; and water-sensitive material contained in the storage volume.

The present disclosure also relates to closure systems that include the hinged lid described herein.

BRIEF DESCRIPTION OF THE DRAWINGS

The figures herein are illustrative in nature and are not intended to be limiting.

DETAILED DESCRIPTION OF THE INVENTION

Figure 1:
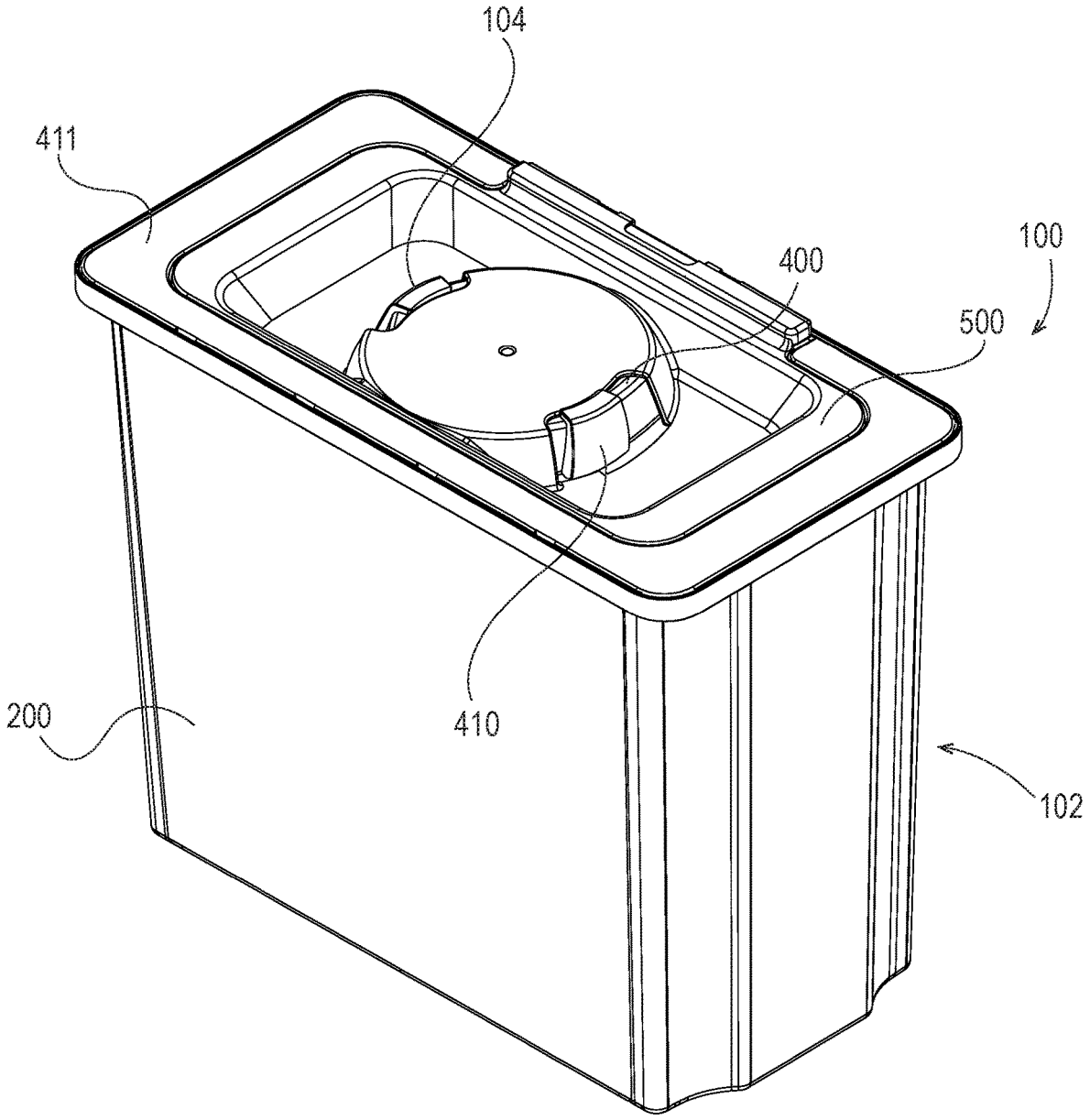
FIG. 1 shows a container system according to the present disclosure.

The present disclosure relates to container systems that have hinged lids that automatically pop open and processes that relate thereto. Upon an initial opening process, the lid opens to an intermediate open position. Such an intermediate position limits the amount of spillage of the contents during accidental opening. A user may urge the lid from the intermediate open position to a fully open position, but upon subsequent openings, the lid springs open to the fully open position automatically. This may be achieved by including in the container system a biasing means, such as an elastic insert, that must be "activated" upon the first opening. Once activated, the biasing means may automatically open the lid to the fully open position, at least for a period of time. Such systems and processes may be desirable to minimize accidental opening and subsequent leakage or product loss during storage or transport, while still providing the convenience and delight of a "pop-up" lid over the course of multiple uses (e.g., laundry loads), for example, on a particular day.

The present disclosure also relates to container systems that contain water-sensitive material, such as water-soluble unitized dose articles. When such container systems contain water-sensitive material, it may often important for the container to be completely closed when not in use to limit water ingress, as water may damage the water-sensitive material. The container systems of the present disclosure may include a hinged lid that automatically pops open unless the locking system is engaged. This system is particularly useful in signaling to the user that the container system is not completely closed. In other words, if a user inadequately closes the lid and does not engage the locking system, the lid will pop open, signaling that another try at closing the container system is required in order to limit the entry of water. Notably, this is a different problem to be solved than that faced by containers that include materials (such as "wet wipes") where loss of water or other volatile substance (e.g., organic solvent) is a problem that must be limited.

The container systems and related processes are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Container System

The present disclosure relates to a container system 100. As shown in FIG. 1, the container system 100 may include a container body 200 and a hinged lid 104. The hinged lid 104 may be part of a closure system 110 that further comprises a frame 300.

Figure 2:
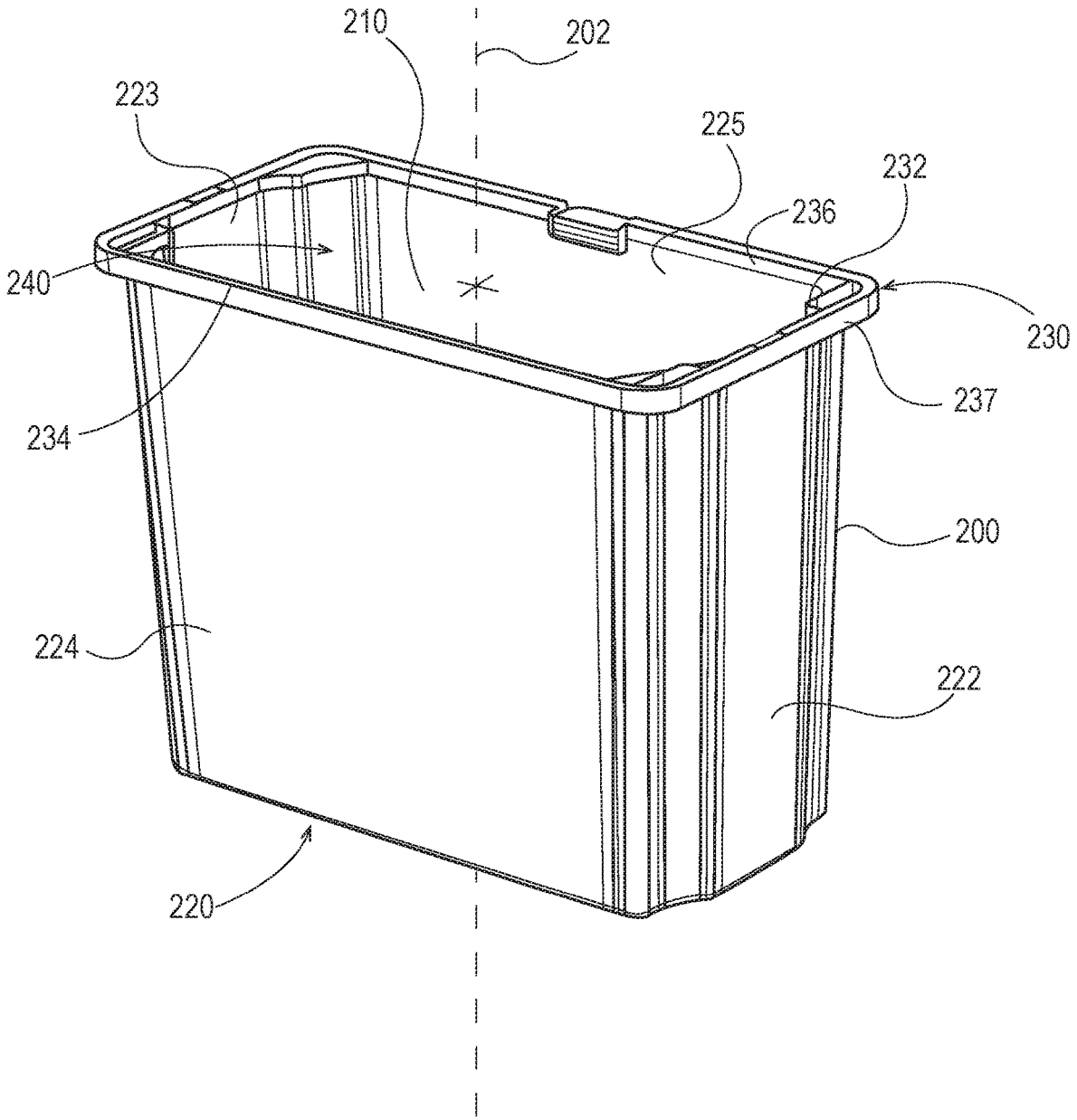
FIG. 2 shows a container according to the present disclosure.

As shown in FIG. 2, the container body 200 may have an opening 240 that provides access to a storage volume 210. The storage volume 210 may contain any suitable material, such as a consumer product, preferably a household care product, preferably a cleaning composition, more preferably a cleaning composition in the form of a unitized dose article 600. Such materials are described in more detail below.

The container system 100 or components thereof may be made of any suitable material. The body 200 may be molded from a suitable plastic material such as polyethylene terephthalate. Any suitable polyolefins and/or polyesters may be used. The frame 300 and/or lid 104 or portions thereof may be formed partially or wholly of a moldable thermoplastic material, such as polypropylene, polyethylene, polystyrene, acrylonitryl butadiene styrene (ABS), polyester, polyvinyl chloride, polycarbonate or elastomer, or a blend of these materials.

The container body 200 may be formed of a clear, transparent, or semi-transparent material, while the frame 300 and/or lid 104 may be formed of a substantially opaque material. The entire container system 100 may be formed of substantially opaque materials. The materials used to form the container system 100 may have one or more colors. The container body 200, frame 300, and/or lid 104 may all of the same color (e.g., all orange or all green). The lid 104 may have a major color and a minor color. The lid 104 may comprise a first portion 400 (e.g., a dial) of a first color and a second portion 500 (e.g., a cover) of a second color. The first and second colors may be different, which may help to make the first portion 400 or portions thereof (e.g., push pads 410, 411) stand out visually.

The body 200 may include a bottom wall 220 and at least one side wall 222. The walls of the body 200 may define the storage volume 210 and may be in any suitable shape, for example the shape of a cylindrical or a rectangular container. The body may include a front wall 224, a rear wall 225, and two side walls 222, 223. The walls 222, 223, 224, 225 may be substantially flat, convex, or a mixture thereof.

The walls 222, 223, 224, 225 may include flat portions or even concave portions 290 that extend inwardly towards the storage volume 210. Instead of having pointed or convexly rounded corners, the body 200 may include corners that are flat and/or concave. A cross-section of at least a portion of the body 200 may have a substantially octagonal shape. The flat and/or concave portions 290 may be located near the opening 240 of the body 200. The flat and/or concave portions 290 may provide a gripping surface that makes the containers 100 easier to be grabbed and/or picked up by a consumer. The flat and/or concave portions 290 may also make the containers 100 easier to be picked up by robot arms when being moved by the manufacturer during filling and/or packing, for example, when being placed into or onto secondary packaging, such as a box, a crate, or a pallet.

The body 200 may include a neck 230. The neck 230 may terminate in a rim 232. The rim 232 may define an opening 240 of the body 200. The opening 240 may have a periphery 234. The neck 240 may have an inner surface 236 that faces a central axis 202 of the opening 240. The neck 230 may have an outer surface 237 that is opposite the inner surface 236 of the neck 230 and faces away from the central axis 202.

It may be desirably for the body to have a relatively large opening 240, for example, in order to facilitate filling the container body 200 with contents.

Figure 3:
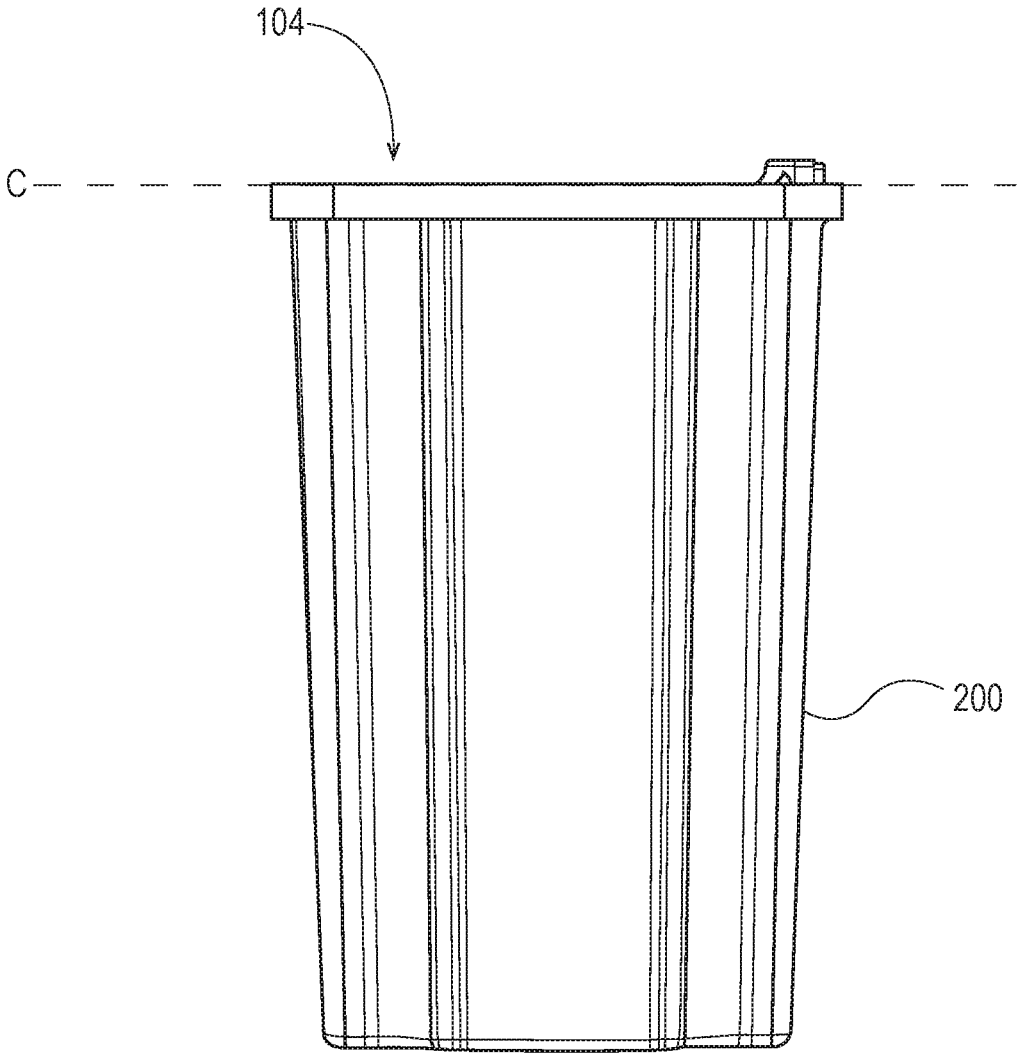
FIG. 3 shows a side view of a container system according to the present disclosure, with the lid in a closed position.

As shown in FIG. 3, the hinged lid 104 may have a closed position. When in the closed position, the lid 104 covers the opening 210 of the body 200, blocking access thereto. In the closed position, the lid 104 substantially forms a plane ("C" in FIGS. 3-5) that is used in reference to the first and second angles formed by the lid in the intermediate open position and fully open position, respectively.

Figure 4:
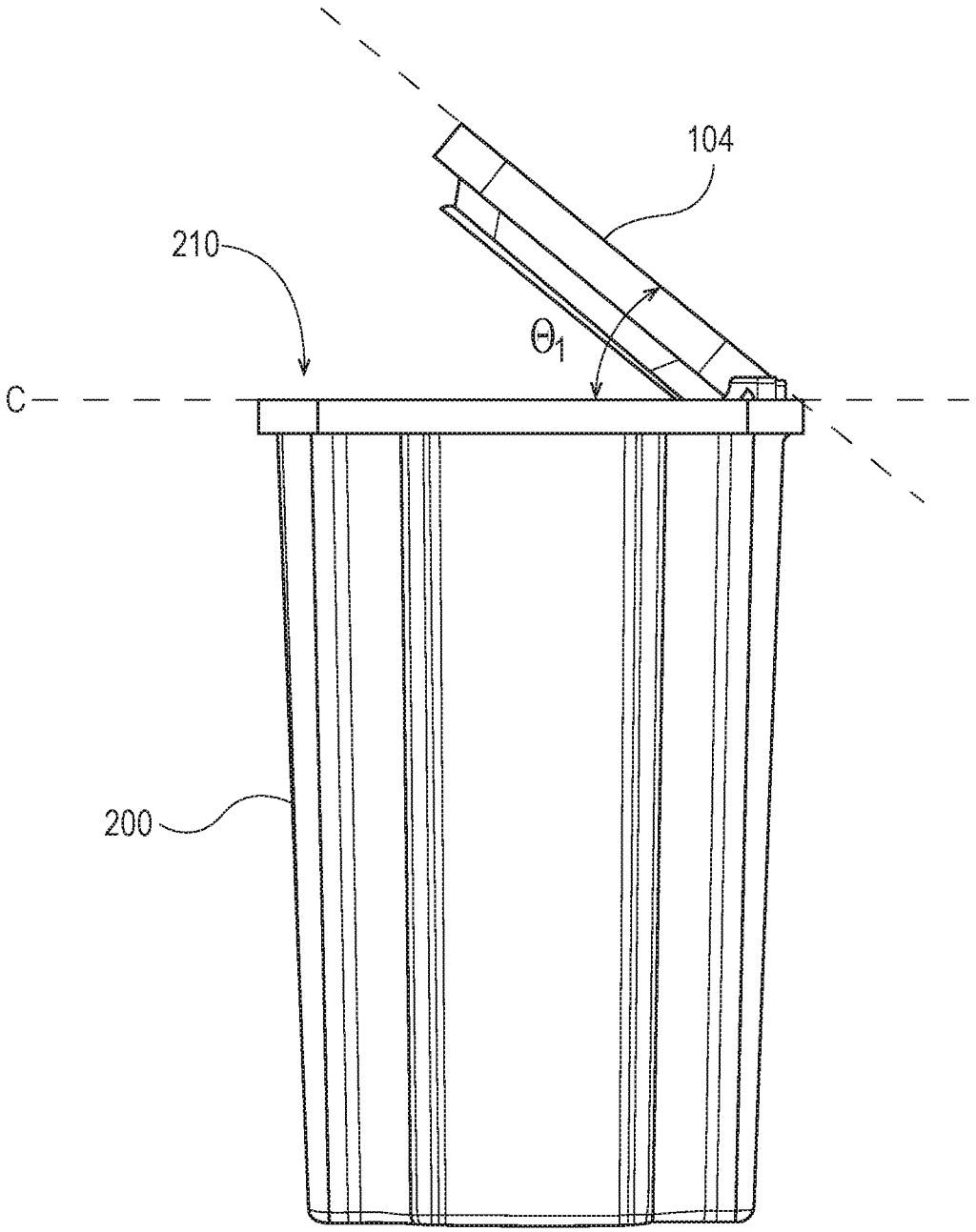
FIG. 4 shows a side view of a container system according to the present disclosure, with the lid in an intermediate open position.

As shown in FIG. 4, the hinged lid 104 can open to a predetermined intermediate open position. The lid 104 forms a first angle $\theta_1$ at the intermediate open position relative to the closed position. The first angle $\theta_1$ may be from about 1° to about 90°, or from about 5° to about 90°, preferably from about 5° to about 45°, more preferably from about 5° to about 30°, or even from about 5° to about 20°. Upon a first accessing step, the lid 104 may be moved from the closed position to the intermediate open position. The lid 104 may be urged from the closed position to the intermediate open position by a user or by a biasing means 130.

Figure 5:
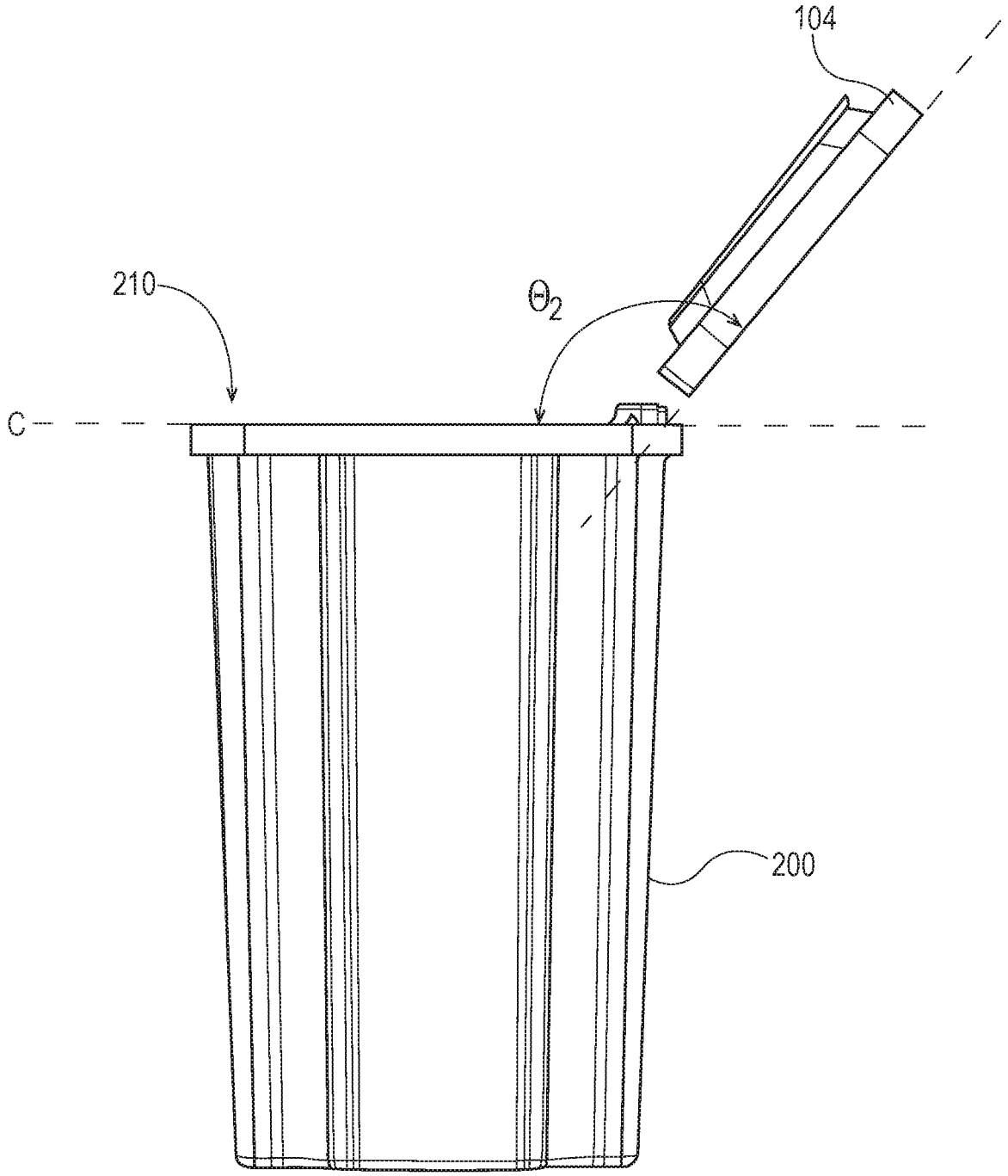
FIG. 5 shows a side view of a container system according to the present disclosure, with the lid in a fully open position.

As shown in FIG. 5, the hinged lid 104 can open to a predetermined fully open position. The lid 104 forms a second angle $\theta_2$ at the fully open position relative to the closed position. The second angle $\theta_2$ may be from about 90° to about 270°, preferably from about 90° to about 180°, more preferably from about 110° to about 150°, or from about 110° to about 135°. During a first accessing step, a user may need to activate the biasing means 130 by urging the lid 104 from the intermediate open position to the fully open position. Once the biasing means 130 is activated, the activated biasing means can urge the lid 104 from the closed position to the fully open position, for example during a second accessing step, once the locking means 140 is disengaged.

As described above, the container system 100 may include a biasing means 130 that urges the lid 104 to the intermediate open position and/or the fully open position. The biasing means 130 may be any suitable mechanism for biasing the lid 104 to either open position. The biasing means 130 may connected to, or even integral to, one or more parts of the container system 100, such as the container body 200 and the lid 104, or the lid 104 and a frame 300. The biasing means 130 may be removable from and/or replaceable to the container system. The biasing means 130 may be selected from a spring, an elastic insert, an elastic band, a resilient flange, or any other suitable means. The biasing means 130 may be made of any suitable material, such as plastic, silicon, metal, or a combination thereof. It may be desirable to select a biasing means 130 and/or a material for the biasing means 130 that shows little to no deformation or warping upon storage and/or repeated use.

The lid 104 and/or biasing means 130 may be selected by one of ordinary skill to provide the desired pop-up effect. For example, the lid 104 may be sized and dimensioned so that the biasing force/torque provided by the biasing means 130 is sufficient to open the lid 104; if the lid 104 is too large, it may not open with the desired effect. Similarly, the material and/or mechanical properties (e.g., elasticity) of the biasing means 130 can be selected to provide the desired effect.

The biasing means 130 (e.g., an elastic insert 132) may be characterized by a Tensile Elongation value (200 mm/min; Across Flow: Break; 2.00 mm) of about 300% to about 500%, or from about 350% to about 450%, or about 400%, as determined according to test method ISO 37. The biasing means 130 (e.g., an elastic insert 132) may be characterized by a Tensile Elongation (200 mm/min; Flow: Break; 2.00 mm) of about 300% to about 500%, or from about 350% to about 450%, or about 380%, as determined according to test method ISO 37. The biasing means 130 (e.g., an elastic insert 132) may be characterized by a Shore Hardness value (Shore A; 3 sec) of about 40 to about 100, or from about 50 to about 80, or from about 55 to about 65, or about 60, as determined according to test method ISO 868. The ISO (International Organization for Standardization) test methods are known and accessible to one of ordinary skill in the art.

The biasing means 130 may be an elastic insert 132. The elastic insert may be made of any suitable elastic material. The elastic insert may be a thermoplastic elastomer. Thermoplastic elastomers may be desirable compared to other materials such as metal, as thermoplastic elastomers will not corrode, do not have sharp edges that could puncture or abrade materials contained in the container system, and are typically recyclable.

The elastic insert 132 may be characterized by a Tensile Elongation value (200 mm/min; Across Flow: Break; 2.00 mm) of about 300% to about 500%, or from about 350% to about 450%, or about 400%, as determined according to test method ISO 37. The elastic insert 132 may be characterized by a Tensile Elongation (200 mm/min; Flow: Break; 2.00 mm) of about 300% to about 500%, or from about 350% to about 450%, or about 380%, as determined according to test method ISO 37. The elastic insert 132 may be characterized by a Shore Hardness value (Shore A; 3 sec) of about 40 to about 100, or from about 50 to about 80, or from about 55 to about 65, or about 60, as determined according to test method ISO 868. The ISO (International Organization for Standardization) test methods are known and accessible to one of ordinary skill in the art.

The biasing means 130, e.g. an elastic insert 132, may be substantially located on the exterior of the lid, closure system, and/or container system. See, e.g., FIGS. 1, 6, and 9. Locating the biasing means 130 on the exterior of the container enables the opening of the container, frame, and/or closure system to remain as relatively large as possible, whereas locating the biasing means 130 on the interior of the container system can take up valuable space and reduce the relative surface area of the opening. Maintaining a relatively large surface area of the opening can be particularly important when a user is expected to reach inside the container system to remove material (such as unitized dose articles), either by hand or by scoop, rather than pouring the material out by tipping the container. In other words, it may be preferable to select a biasing means 130 that is located on the container system so as not to block or otherwise take up space of the opening(s). Elastic inserts 132 may be particularly amenable to being located on the exterior of a container system and/or space-efficient compared to other biasing means, such as springs, silicone dogbones, and/or "trampolines."

The thermoplastic elastomer may be co-molded with one or more of the parts of the container system 100, for example by bi-injected molding. For example, the thermoplastic elastomer may be formed via co-molding (e.g., bi-injected molding) with the frame 300 and/or the lid 104, typically the frame 300 and the second portion 500. The elastic insert 132 may be a different material than the frame 300 and/or the lid 104.

The present disclosure also relates to a container system that includes: a container body having an opening that provides access to a storage volume; a hinged lid having a closed position that covers the opening and an open position that allows access to the storage volume; a locking means that secures the lid in the closed position; a biasing means that urges the lid to the open position when the locking means are not engaged when the lid is moved from the open position in the direction of the closed position; and water-sensitive material (such as a unitized dose article that includes a cleaning composition, such as a laundry or dish detergent, encapsulated in a water-soluble film) contained in the storage volume. The open position of the lid may be an intermediate open position and/or a fully open position.

Figure 6:
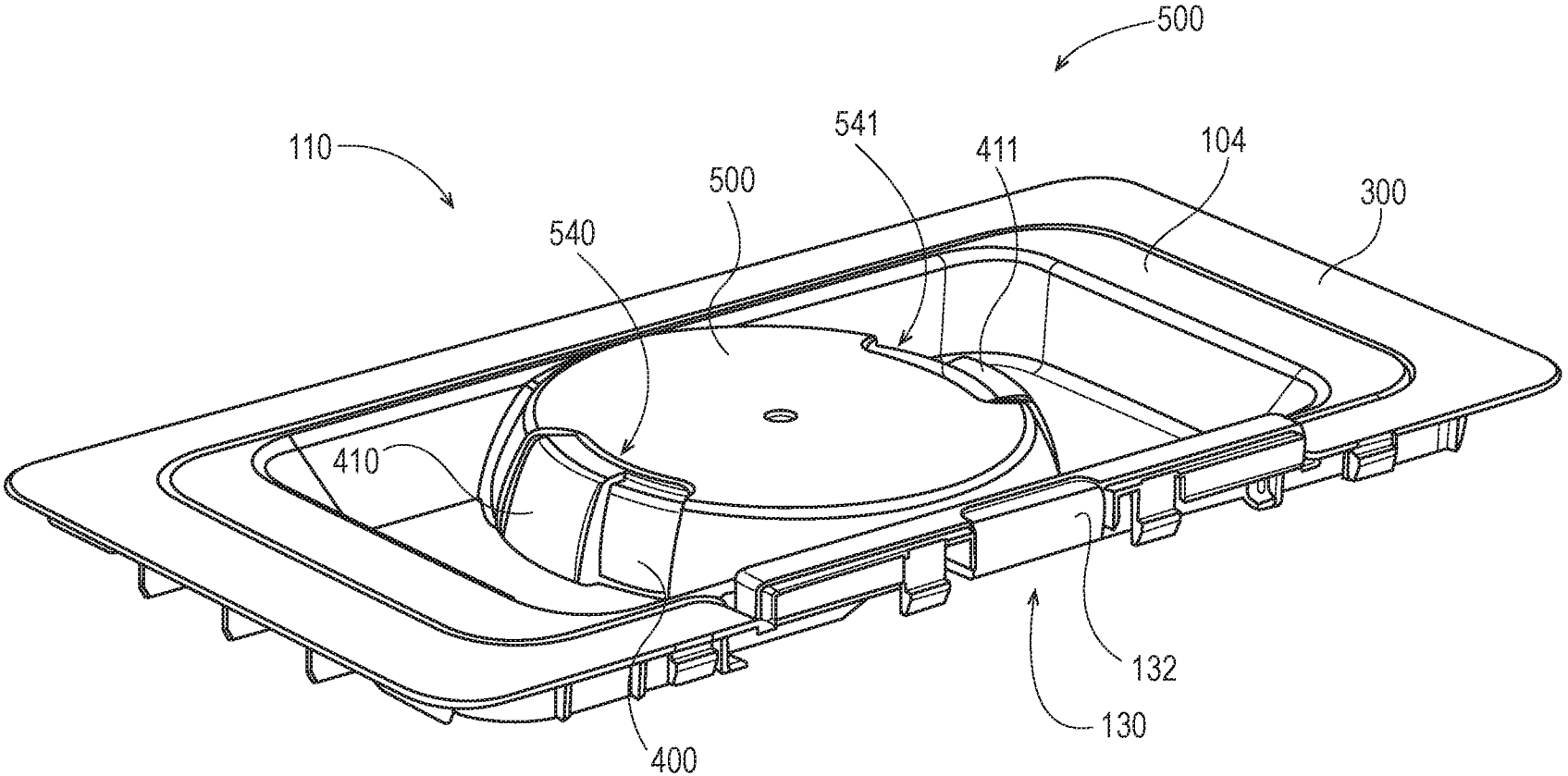
FIG. 6 shows a closure system according to the present disclosure.

FIG. 6 shows a perspective view of a closure system 110 according to the present disclosure. The closure system 110 include a lid 104, a frame 300, and biasing means 130.

The container system 100 may include locking means 140 that secures the lid 104 in the closed position. In order for the lid 104 to be moved from the closed position to an open position (intermediate or fully), the locking means 140 may need to be disengaged. The locking means 140 may comprise a latch and a catch. The lid 104 may comprise the latch. The frame 300 may comprise the catch. The latch may be disengaged from the catch by lifting, rotating, pressing, pulling, or a combination thereof.

As seen in FIG. 6, the lid may comprise a first portion 400, which may be in the form of a dial. The lid may comprise a second portion 500, which may be in the form of a cover. The first portion 400 may be nonintegrally connected to the second portion 500.

The first portion 400 may include at least one push pad 410, or at least two push pads 410, 411. The push pads 410, 411 may need to be pressed radially inward in order for the locking means 140 to be disengaged.

The first portion 400 may be rotatable relative to the second portion 500 of the lid 104. The first portion 400 may need to be rotated in order for the locking means 140 to be disengaged. In order for the locking means 140 to be disengaged, the push pads 410, 411 of the first portion 400 may need to be pressed radially inward, and the first portion 400 may need to be rotated relative to the second portion 500. In other words, the lid 104 may include squeeze-and-turn functionality. The first portion 400 may not be able to be rotated until the push pads 410, 411 are pressed.

The second portion 500 may substantially cover the first portion 400. The second portion may include apertures 540, 541 through which the push pads 410, 411 are accessible when the second and first portions 400, 500 are connected.

Figure 7:
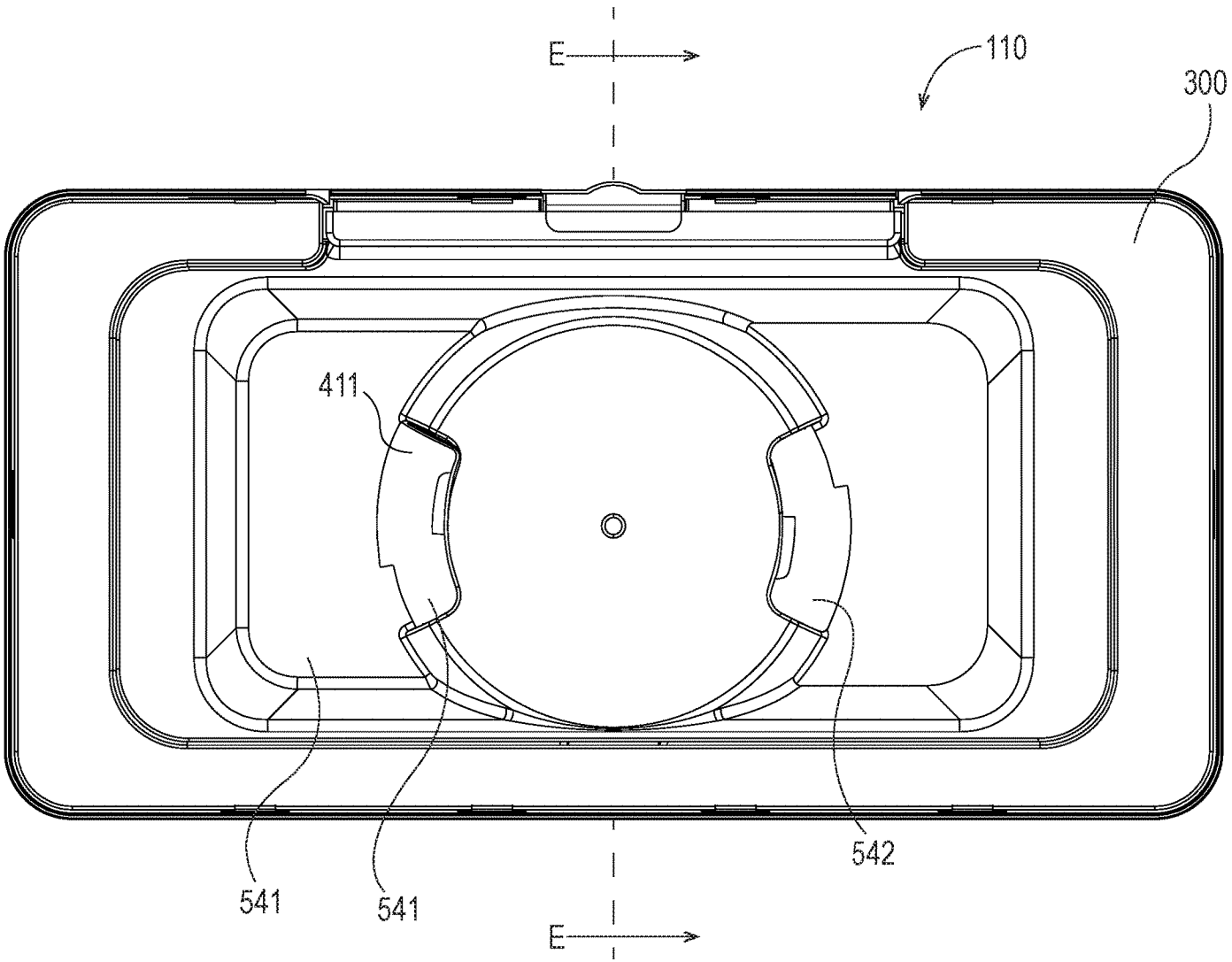
FIG. 7 shows a top view of a closure system according to the present disclosure.
Figure 8:
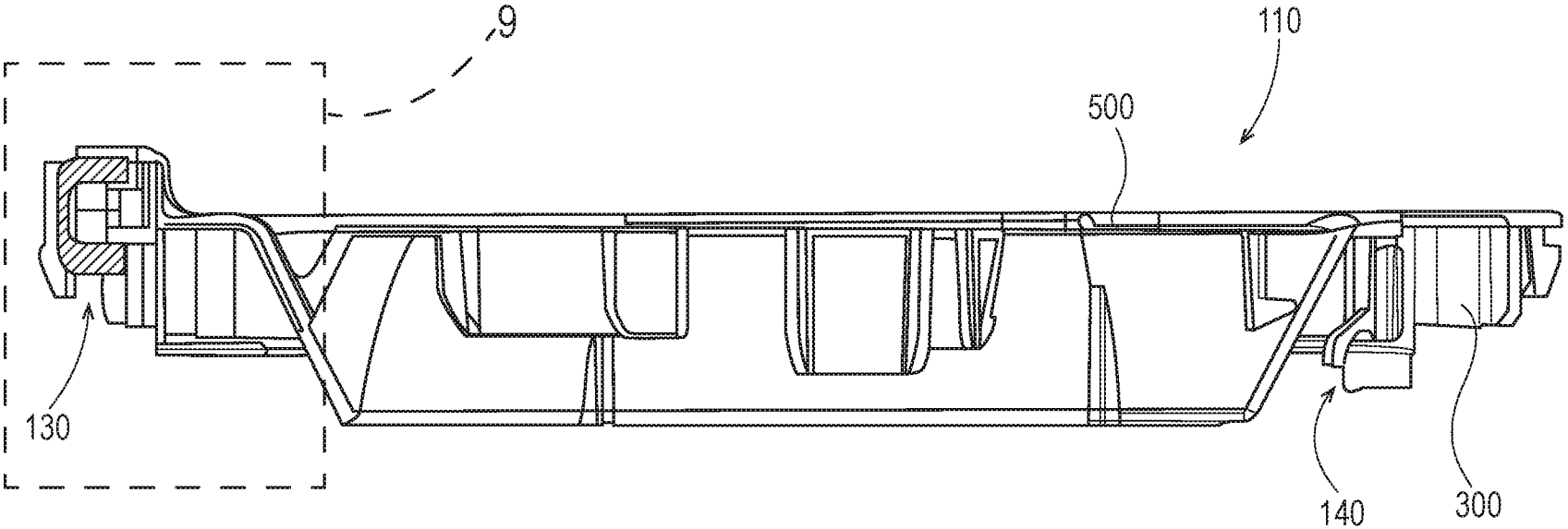
FIG. 8 shows a cross-sectional view of the closure system of FIG. 7, taken at line E-E.
Figure 9:
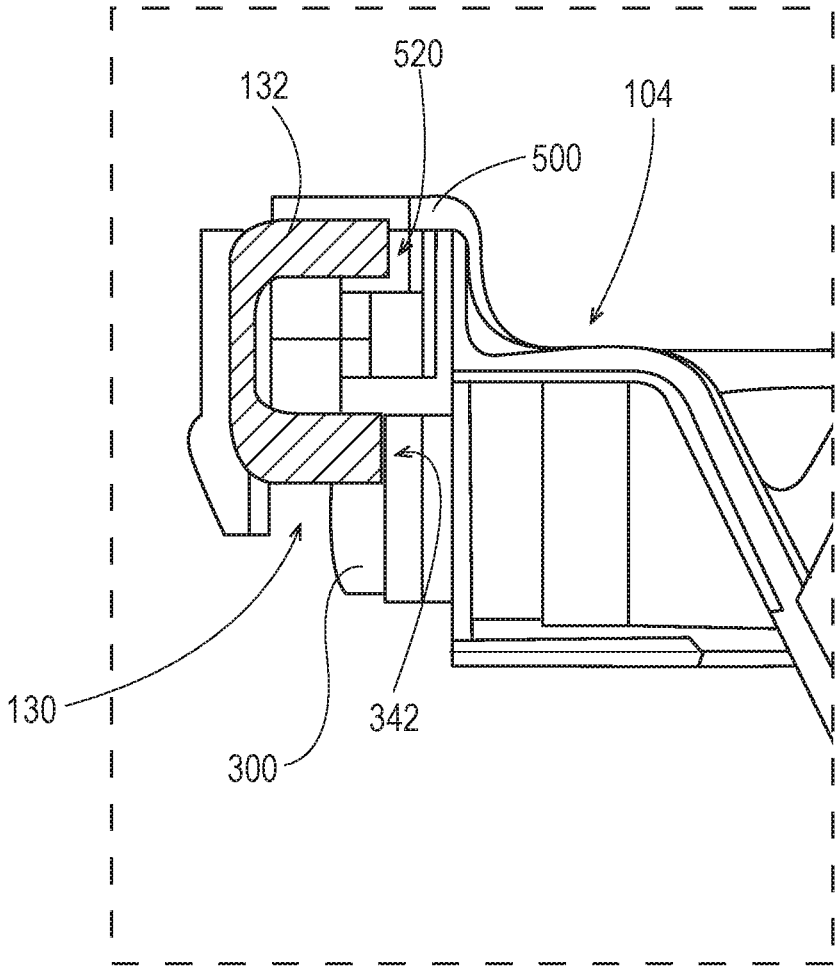
FIG. 9 shows detail F of FIG. 8.

FIG. 7 shows a top view of a closure system 110 according to the present disclosure, including a frame 300 and the second portion 500; the first portion 400 is not shown. The closure system 110 comprises biasing means 130. FIG. 8 shows a cross-sectional view of the closure system as viewed at line E-E in FIG. 7. FIG. 9 shows a zoomed-in view of the portion of the closure system circled in FIG. 8.

As seen in FIG. 9, the biasing means 130 may be an elastic insert 132 that is connected to the frame 300 and the lid 104. The frame 300 may include a port 342 configured to receive the biasing means 130, e.g. the elastic insert 132. The lid 104 may include a port 520 configured to receive the biasing means 130, e.g. the elastic insert 132. The biasing means 130, e.g. the elastic insert 132, may be connected to the container system at the ports 342, 520. When the lid 104 is in the closed position, the biasing means 130, e.g. the elastic insert 132, may be bent into a C-shape. When the locking means are disengaged, the biasing means 130 lifts the lid 104 to the intermediate and/or fully open position. Although FIGS. 7-9 show the biasing means 130 on the exterior of the container system 100, the biasing means 130 may be located at least partly or entirely on the interior of the container system 100, in which case the lid would be pushed to an open position by the biasing means 130 instead of pulled.

The container systems 100 described herein may contain any suitable material or composition. Typical materials and compositions include, but are not limited to, fabric care treatments, hard surface cleaners, soaps, shampoos, conditioning agents, pesticides, paint, solvents, industrial chemicals, industrial hardware (e.g., nails, screws, etc.), medicines, pills, food, and the like. The material may be water-sensitive material, meaning that the material has a tendency to dissolve or degrade when exposed to liquid water or water vapor. The material may be a consumer product, preferably a household care product, preferably a cleaning composition, more preferably a cleaning composition in the form of a unitized dose article.

The material may be a water-sensitive material, meaning that if the material is exposed to water prior to the material's intended use, the material may suffer an adverse effect. For example, at least a portion of the material may dissolve, degrade, or react in an undesirable way. If the material is a unitized dose article, the article may dissolve, leak, become sticky, have a greasy feel, or other undesirable effects in the presence of water. Water may take the form of a liquid or a gas, e.g. humidity in the ambient environment. To limit the material's exposure to water, it is typically desirable to securely close the container system when not in use.

Non-limiting examples of useful compositions include light duty and heavy duty liquid detergent compositions, hard surface cleaning compositions (such as dish care compositions, including compositions intended for use in an automatic dishwashing machine), detergent gels commonly used for laundry, bleach and laundry additives, shampoos, body washes, and other personal care compositions. Compositions may take the form of a liquid, gel, solid, a unitized dose article, or mixtures thereof. Liquid compositions may comprise a solid. Solids may include powder or agglomerates, such as micro-capsules, beads, noodles or one or more pearlized balls or mixtures thereof. Such a solid element may provide a technical benefit, through the wash or as a pre-treat, delayed or sequential release component; additionally or alternatively, it may provide an aesthetic effect.

In some aspects, the compositions may comprise one or more of the following non-limiting list of ingredients: opacifier; antioxidant; fabric care benefit agent; detersive enzyme; deposition aid; rheology modifier; builder; bleaching agent; bleach precursor; bleach catalyst; chelant; perfume; whitening agent; pearlescent agent; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents; corrosion inhibitors and/or anti-tarnish agents; rinse aids. Additionally or alternatively, the compositions may comprise surfactants and/or solvent systems.

The composition may be a flowable composition that can be scooped, such as a free-flowing granular or powdered composition. In such cases, the container system 100 may further comprise a scoop adapted to fit into the container system 100 and to scoop the scoopable composition.

Figure 10:
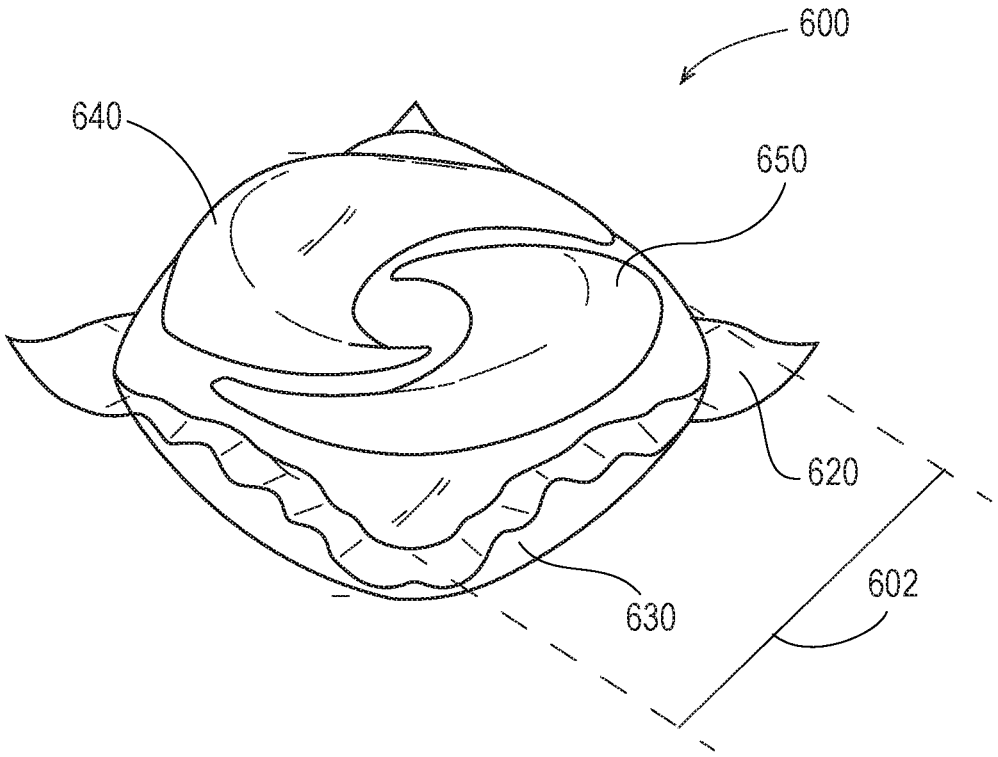
FIG. 10 shows a unitized dose article according to the present disclosure.

The container systems 100 described herein are particularly useful for containing compositions in the form of an article 600. FIG. 10 shows an example of a unitized dose article 600. The article 600 may be suitable to be grasped by an adult human hand. Such articles 600 may have an article width 602 of from about 10 mm to about 100 mm, or from about 20 mm to about 70 mm, or from about 35 mm to about 55 mm, or from about 40 mm to about 50 mm. If the article 600 is rectangular in shape, the article width 602 is measured as the greatest distance between two parallel sides. When an article 600 has a variable width, the article width 602 is the average of such widths. Such articles 600 may have a height, of from about 10 mm to about 100 mm, or from about 15 mm to about 70 mm, or from about 20 mm to about 50 mm, or from about 25 mm to about 35 mm. When an article 600 has a variable height, the article height is measured at the maximum height of the article.

Typically, the container systems 100 described herein are useful for containing articles 600 of unitized doses of a composition (e.g., in counts of 15, 25, 50, 66, 77, etc.), typically of a cleaning composition, more typically of a laundry detergent or hard surface treatment composition. The unitized dose article 600 may be a pouch. The pouch may be formed from a water-soluble film 620, such as a polyvinyl alcohol film, including those available from MonoSol, LLC. The film 620 may encapsulate the composition in a compartment. The pouch may comprise a single compartment, or it or may comprise multiple compartments 630, 640, 650.

The pouch may contain various compositions, which may be of varying colors that may be seen from outside of the pouch. A multi-compartment pouch may contain the same or different compositions in each separate compartment. The compartments may be side-by-side or superposed, for example one or two smaller compartments 640, 650 superposed on one larger compartment 630. This multi-compartment feature may be utilized to keep compositions containing incompatible ingredients (e.g., bleach and enzymes) physically separated or partitioned from each other. It is believed that such partitioning may expand the useful life and/or decrease physical instability of such ingredients.

The compositions of the unitized dose articles 600 typically have low levels of water. In some aspects, the compositions 600 comprise less than about 50%, or less than about 30%, or less than about 20%, or less than about 15%, or less than about 12%, or less than about 10%, or less than about 8%, or less than 5%, or less than 2% water by weight of the composition 600. In some aspects, the composition 600 comprises from about 0.1% to about 20%, or from about 1% to about 12%, or from about 5% to about 10% water by weight of the composition 600.

Process of Accessing a Container System

The present disclosure relates to a process of accessing a container system 100 that contains a material. The container systems 100, container bodies 200, and closure systems 110 of the present disclosure are suitable for the present process and are described in more detail above and in the accompanying figures.

For example, the container system 100 may include a container body 200 having an opening 240. The opening 240 may provide access to a storage volume 210. The container system 100 may include a hinged lid 104. The lid 104 may be part of a closure system 110. The closure system 110 may further comprise a frame 300. The lid 104 may be hingedly connected to the frame 300.

The hinged lid 104 may have a closed position in which the lid 104 covers the opening 240. The lid 104 may be moveable to a predetermined intermediate open position that forms a first angle $\theta_1$ relative to the closed position. The lid 104 may be moveable to a predetermined fully open position that forms a second angle $\theta_2$ relative to the closed position. The second angle $\theta_2$ is greater than the first angle $\theta_1$. The first angle $\theta_1$ may be from about 1° to about 9°, or from about 5° to about 90°, preferably from about 5° to about 45°. The second angle $\theta_2$ may be from about 90° to about 270°, preferably from about 90° to about 180°, more preferably from about 110° to about 150°, or from about 110° to about 135°.

The container system 100 may include a biasing means 130 that urges the lid 104 to the intermediate open position and/or the fully open position. The biasing means 130 may be selected from a spring, an elastic insert, an elastic band, a resilient flange, or a combination thereof. The biasing means 130 may be an elastic insert 132, preferably comprising a thermoplastic elastomer.

The container system 100 may include locking means 140. The locking means 140 may comprise a latch and a catch. The latch may be on the lid 104. The catch may be on the frame 300 or on the container body 200. The lid 104 may comprise at least one push pad 410, 411 that must be pressed to disengage the locking means. The lid 104 may comprise a first portion 400, such as a dial, and a second portion 500, such as a cover. In order to disengage the locking means 140, the first portion 400 may need to be rotated relative to the second portion 500.

The process may include a first accessing step. A locking means 140 may be disengaged in the first accessing step, which may allow the lid 104 to move from the closed position to the intermediate open position. The lid 104 may be urged from the closed position to the intermediate open position by a user or by a biasing means 130.

The step of disengaging the locking means 140 may comprise a pressing step, for example, where the lid 104 comprises at least one push pad 410, 411 that must be pressed (for example, radially inward) to disengage the locking means. The step of disengaging the locking means 140 may comprise a rotation step, for example, where a first portion 400 (e.g., a dial) of the lid 104 is rotated relative to a second portion 500 (e.g., a cover) of the lid 104. The step of disengaging the locking means 140 may comprise both a pressing step and a rotation step, typically in that order.

The lid 104 may then be manually urged by a user from the intermediate open position to the fully open position. Material may be removed from the storage volume. The container system 100 may then be closed by moving the lid 104 from the fully open position to the closed position.

When the lid 104 is moved to the closed position from the intermediate and/or fully open position, the container system 100 may produce a signal that indicates to the user that the container system is securely closed. The signal may be an audible signal (such as an audible click), a tactile signal (such as a vibration), or a combination thereof, preferably at least an audible signal.

The process may include a second accessing step. The locking means 140 may be again disengaged in the second accessing step. When the locking means 140 are disengaged, the biasing means 130 may urge the lid 104 from the closed position to the fully open position, bypassing the intermediate open position without additional intervention, such as a push or other urging from a user, as was required in the first accessing step. The second accessing step may conclude by closing the container system 100 by moving the lid 104 from the fully open position to the closed position.

As described above, the biasing means 130, such as an elastic insert 132 (which may include a thermoplastic elastomer) may become activated during the first accessing step so that it is able to move the lid 104 from the closed position to the fully open position without stopping at the intermediate open position. However, even once activated, the biasing means 130 may lose some of the activation energy over time and may need to be re-activated. Therefore, for maximum convenience, it may be desirable for the first and second accessing steps to be performed in relatively close succession, for example on the same day. The first accessing step and the second accessing step may both occur within about twelve hours, or within about eight hours, or within about six hours, or within about four hours of each other.

The processes described herein may further include a third accessing step or more, where when the locking means 140 are disengaged, the biasing means 130 urge the lid 104 from the closed position to the fully open position, bypassing the intermediate open position without additional intervention.

The first accessing step may correspond to a first cleaning treatment, such as treating a first load of soiled laundry or dishes, and the second accessing step may correspond to a second cleaning treatment, such as treating a second load of soiled laundry or dishes. The material removed from the first and/or second accessing step may be a household care composition, such as any of those described herein. The material, such as a unitized dose article 600, may be placed into a vessel, such as an automatic washing machine, along with a first and/or second load of soiled laundry or dishes for a cleaning treatment, such as a wash cycle, in the presence of water. The material, such as a detergent composition contained in a unitized dose article, may be diluted 300- to 700-fold in water.

Combinations

Specifically contemplated combinations of the disclosure are herein described in the following lettered paragraphs. These combinations are intended to be illustrative in nature and are not intended to be limiting.

A. A process of accessing a container system that contains a material, where the container system comprises a container body having an opening that provides access to a storage volume and a hinged lid having a closed position that covers the opening, the lid further having a predetermined intermediate open position that forms a first angle relative to the closed position and a predetermined fully open position that forms a second angle relative to the closed position, where the second angle is greater than the first angle, the container system further comprising a biasing means, preferably located on the exterior of the container, that urges the lid to the intermediate open position and/or the fully open position, the process comprising the steps of: a first accessing step where a locking means is disengaged to allow the lid to move from the closed position to the intermediate open position, the lid is then manually urged by a user from the intermediate open position to the fully open position, material is removed from the storage volume, and the container system is closed by moving the lid from the fully open position to the closed position; and a second accessing step where the locking means is disengaged and the biasing means urges the lid from the closed position to the fully open position, bypassing the intermediate open position without additional intervention.

B. A process according to paragraph A, wherein the first angle is from about 1° to about 90°, preferably from about 5° to about 90°, more preferably from about 5° to about 45°.

C. A process according to any of paragraphs A-B, wherein the second angle is from about 90° to about 270°, preferably from about 90° to about 180°, more preferably from about 110° to about 150°, even more preferably from about 110° to about 135°.

D. A process according to any of paragraphs A-C, wherein the biasing means is selected from a spring, an elastic insert, an elastic band, a resilient flange, or a combination thereof.

E. A process according to paragraph D, wherein the biasing means is an elastic insert, preferably comprising a thermoplastic elastomer.

F. A process according to any of paragraphs A-E, wherein the lid is part of a closure system that further includes a frame, where the lid is hingedly connected to the frame.

G. A process according to any of paragraphs A-F, wherein the container system produces an audible signal when the lid is moved to the closed position from the intermediate open position and/or the fully open position.

H. A process according to any of paragraphs A-G, wherein the locking means comprise a latch and a catch.

I. A process according to any of paragraphs A-H, wherein the step of disengaging the locking means comprises a pressing step.

J. A process according to paragraph I, wherein the lid comprises at least one push pad that must be pressed to disengage the locking means.

K. A process according to paragraph I, wherein the step of disengaging the locking means further comprises a rotation step.

L. A process according to any of paragraphs A-K, wherein the step of disengaging the locking means comprises a rotation step.

M. A process according to any of paragraphs A-L, wherein the material is a consumer product, preferably a household care product, preferably a cleaning composition, more preferably a cleaning composition in the form of a unitized dose article.

N. A process according to any of paragraphs A-M, wherein the first accessing step and the second accessing step both occur within about twelve hours, or within about eight hours, or within about six hours, or within about four hours of each other.

O. A container system comprising: a container body having an opening that provides access to a storage volume, a hinged lid having a closed position that covers the opening, the lid further having a predetermined intermediate open position that forms a first angle to the closed position and a predetermined fully open position that forms a second angle relative to the closed position, where the second angle is greater than the first angle, a locking means that secures the lid in the closed position, and a biasing means, preferably located on the exterior of the container system, that urges the lid to the intermediate open position and/or the fully open position, where upon a first accessing step, a locking means is disengaged to allow the lid to be moved from the closed position to the intermediate open position, where a user must activate the biasing means by urging the lid from the intermediate open position to the fully open position, where upon a second accessing step, the activated biasing means urges the lid from the closed position to the fully open position when the locking means is disengaged.

P. A container system according to paragraph O, wherein the first angle is from about 1° to about 90°, preferably from about 5° to about 90°, more preferably from about 5° to about 45°.

Q. A container system according to any of paragraphs O-P, wherein the second angle is from about 90° to about 270°, preferably from about 90° to about 180°, more preferably from about 110° to about 150°, even more preferably from about 110° to about 135°.

R. A container system according to any of paragraphs O-Q, wherein the biasing means is selected from a spring, an elastic insert, an elastic band, a resilient flange, or a combination thereof.

S. A container system according to paragraph R, wherein the biasing means is a thermoplastic elastomer.

T. A container system according to any of paragraphs O-S, wherein the lid is part of a closure system that further includes a frame, where the lid is hingedly connected to the frame.

U. A container system comprising: a container body having an opening that provides access to a storage volume; a hinged lid having a closed position that covers the opening and an open position that allows access to the storage volume; a locking means that secures the lid in the closed position; a biasing means, preferably located on the exterior of the container system, that urges the lid to the open position when the locking means are not engaged when the lid is moved from the open position in the direction of the closed position; and water-sensitive material contained in the storage volume.

V. A container system according to paragraph U, wherein the biasing means is selected from a spring, an elastic insert, an elastic band, a resilient flange, or a combination thereof.

W. A container system according to any of paragraphs U-V, wherein the biasing means is a thermoplastic elastomer.

X. A container system according to any of paragraphs U-W, wherein the lid is part of a closure system that further includes a frame, where the lid is hingedly connected to the frame.

Y. A container system according to any of paragraphs U-X, wherein the water-sensitive material comprises a cleaning composition in the form of a unitized dose article, where a water-soluble film encapsulates the composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container system comprising:

a container body having an opening that provides access to a storage volume, a hinged lid having a closed position that covers the opening, the lid further having a predetermined intermediate open position that forms a first angle to the closed position and a predetermined fully open position that forms a second angle relative to the closed position, where the first angle is from about 5° to about 90°, where the second angle is from about 90° to about 180°, and where the second angle is greater than the first angle, a locking means that secures the lid in the closed position, and a biasing means that urges the lid to the intermediate open position and/or the fully open position, wherein the biasing means is an elastic insert, wherein the elastic insert comprises a thermoplastic elastomer, and wherein the elastic insert is characterized by one or more of the following:

(a) a Tensile Elongation value (200 mm/min; Across Flow: Break; 2.00 mm) of about 300% to about 500%, as determined according to test method ISO 37; and/or (b) a Tensile Elongation (200 mm/min; Flow: Break; 2.00 mm) of about 300% to about 500%, as determined according to test method ISO 37; and/or (c) a Shore Hardness value (Shore A; 3 sec) of about 40 to about 100, as determined according to test method ISO 868;

where upon a first accessing step, the locking means is disengaged to allow the lid to be moved from the closed position to the intermediate open position, where a user must activate the biasing means by urging the lid from the intermediate open position to the fully open position, where upon a second accessing step, the activated biasing means urges the lid from the closed position to the fully open position when the locking means is disengaged.

2. A container system according to claim 1, wherein the first angle is from about 5° to about 30°.

3. A container system according to claim 1, wherein the second angle is from about 110° to about 150°.

4. A container system according to claim 1, wherein the lid is part of a closure system that further includes a frame, where the lid is hingedly connected to the frame.

5. A container system according to claim 1, wherein the locking means comprises a latch and a catch.

6. A container system according to claim 1, wherein the elastic insert is characterized by two or more of the following:

(a) a Tensile Elongation value (200 mm/min; Across Flow: Break; 2.00 mm) of about 300% to about 500%, as determined according to test method ISO 37; and/or (b) a Tensile Elongation (200 mm/min; Flow: Break; 2.00 mm) of about 300% to about 500%, as determined according to test method ISO 37; and/or (c) a Shore Hardness value (Shore A; 3 sec) of about 40 to about 100, as determined according to test method ISO 868.

7. A container system according to claim 1, wherein the storage volume contains a household care product.

* * * * *